United States Patent [19]

Conrad

[11] Patent Number: 4,992,068

[45] Date of Patent: Feb. 12, 1991

[54] EDUCATIONAL PLAY HOUSE

[76] Inventor: Peter M. Conrad, 211 Lucinda, Fairview Heights, Ill. 62208

[21] Appl. No.: 458,325

[22] Filed: Dec. 28, 1989

[51] Int. Cl.[5] ..... A63H 33/04; A63H 3/52; A63J 19/00; B65D 5/00

[52] U.S. Cl. ..... 446/85; 446/82; 446/478; 229/122; 229/125.23; 229/125.21

[58] Field of Search ..... 229/122, 23 R, 125.23, 229/125.21, 125.39; 446/82, 85, 476, 478, 488, 901

[56] References Cited

U.S. PATENT DOCUMENTS

| | | | |
|---|---|---|---|
| 1,237,161 | 8/1917 | Bowen | 446/82 |
| 1,473,432 | 11/1923 | Huye | 229/125.21 |
| 1,756,526 | 4/1930 | Thompson | 446/478 X |
| 2,020,196 | 11/1935 | Mallgraf | 446/478 |
| 2,137,705 | 11/1938 | Tiefry | 229/122 X |
| 2,734,307 | 2/1956 | Oravets | 446/476 X |
| 3,274,706 | 9/1966 | Friend | 446/901 X |
| 3,548,552 | 12/1970 | McBride | 446/478 X |
| 3,650,459 | 3/1972 | Tucker | 229/23 R X |
| 4,504,497 | 3/1985 | Kurth et al. | 229/23 R X |
| 4,556,167 | 12/1985 | Fox et al. | 229/125.39 X |

FOREIGN PATENT DOCUMENTS

| | | | |
|---|---|---|---|
| 2373312 | 7/1978 | France | 446/478 |
| 588518 | of 0000 | United Kingdom | 446/478 |
| 106130 | 5/1917 | United Kingdom | 229/125.21 |
| 713980 | 8/1954 | United Kingdom | 446/478 |

*Primary Examiner*—Robert A. Hafer
*Assistant Examiner*—D. Neal Muir
*Attorney, Agent, or Firm*—Edward R. Weber

[57] ABSTRACT

A play house apparatus aimed at children whose ages range from eighteen months to nine or ten years which is designed to provide entertainment and to introduce, teach and/or reinforce any number of artistic, theatric and imaginative skills as well as fundamental skills, such as alphabet recognition, handwriting, numeric skills, musical scales, and the like.

4 Claims, 2 Drawing Sheets

EDUCATIONAL PLAY HOUSE

FIELD OF THE INVENTION

The present invention relates to toys, and more particularly to play houses, which can be used by children of varying ages and developmental stages and which have the combined purposes of providing entertainment and of introducing, teaching and/or reinforcing any number of artistic, theatric and imaginative skills as well as fundamental skills, such as alphabet recognition, handwriting, numeric skills, musical scales, etc.

BACKGROUND

Children, it would seem, have the imaginative capacity to create playthings from the most mundane objects. Likewise, at times it would seem that they have a limitless capacity to learn. As a result, both toy makers and educators have tried to capitalize on these capabilities for a variety of reasons.

The present invention also seeks to use children's capacities for imagination and learning by providing them with a structure which can be transformed into a variety of playthings, such as a truck, car, fire engine, boat, airplane, hospital, school, puppet theater, or even a maze. The present invention can also be used as a three dimensional chalkboard, of sorts, by providing a surface which can be used for coloring, decorating, and writing, among other things.

Accordingly it is a general object of the present invention to provide a simple and inexpensive toy, the entertainment value of which is limited only by a child's imagination. It is another object of the present invention to provide a toy which presents opportunities for artistic expression. It is further object of the present invention to provide a medium for learning and practicing fundamental skills, such as reading, handwriting, arithmetic, color recognition, and musical scales, among other things. It is another object of the present invention to provide a useful device for storing toys, clothing, etc., when desired. These together with other objects and features, which will be in part apparent and in part pointed out, reside in the details of construction and operation as more fully described and claimed hereinafter.

SUMMARY OF THE INVENTION

The present invention is a play house apparatus which is aimed at children whose ages range from eighteen months to approximately nine or ten years and which is designed to be used by one or more children.

The apparatus consists of three primary pieces, which constitute a top, bottom, and sides, and a corner piece. When assembled, the pieces form a six-sided chamber. The top and bottom are identical in size and consist of a flat surface which is scored and folded to form a lip completely around the flat surface. The side section is scored and folded so that it creates a rectangular structure when the lateral edges are mated. It is additionally sized so that when it is folded for use, the top and bottom can be mated with the open ends to provide additional stability and create further opportunities for play. The primary pieces are also scored to provide openings of various sizes and shapes to allow access to the play house, provide openings through which hands, feet, or other articles might be passed, and provide openings which can be looked through, among other things.

The play house apparatus can be made of any of a variety of known materials. However, it preferably is constructed of a lightweight, yet durable material, so that it can be handled by a child while at the same time being able to survive the rigors of play. Furthermore, the surface of the construction materials will preferably be prepared, inside and out, with a material which will allow other items to adhere to the surface and which is erasable. In a preferred embodiment, the openings scored into the primary pieces will be provided with means which are capable of maintaining them in an open or closed position, as desired.

The play house apparatus may have many embodiments. In one embodiment, the side wall is folded along the score lines and mated with the plastic corner piece. The top and bottom are then mated with the side walls to add stability and enclose the apparatus. The top and bottom of the apparatus are scored to incorporate door-like openings in each piece to permit children easy access and exit from the play house. These "doors" will include an opening through which a hand or finger could be inserted to pull open or push close the door. Also, one side wall of the play house is scored to include an opening for a stage with adjacent openings through which puppets may be passed. The stage door, in this embodiment, is fitted with means which allow it to be semi-permanently attached to the side wall during performances. In other side walls, openings of a size suitable for discrete viewing are cut; also openings through which hands or feet may be extended or toys or other articles may be passed.

In another embodiment, the side wall is folded along the score lines and the lateral edges semi-permanently mated using a material such as "Velcro". The top and bottom are then slid inside the side walls to add stability and enclose the apparatus. The walls and top and bottom are held in place by a material such as "Velcro". Once again, openings allowing access and exit to children, permitting vision, and allowing other play activities to occur are provided in the top, bottom, and side walls.

In a third embodiment, the openings in the top, bottom, and side walls could be cut and sized so that they could be removed or inserted at a child's discretion.

In use, the play house apparatus would be assembled and the child allowed to play. Because the surface of the apparatus has semi-permanent adherent qualities, the child could decorate the apparatus with any number of plastic pieces, such as "Colorforms". The apparatus could thus be decorated with various shapes, fictional or nonfictional characters, animals, colors, letters, or musical notes, among other things, to make his "house", "hospital", "vehicle", or other imaginary plaything into a customized creation.

Additionally, since the surface of the apparatus is erasable, the child could decorate the apparatus with numbers, colors, alphabet letters, or artistic creations, among other things, using markers or crayons to transform his "school", "house", "workplace", or other imaginary plaything into a customized creation. Further, use of markers or crayons in this manner allows the child to practice and/or perfect his handwriting skills, addition and subtraction skills, alphabet recognition skills, drawing skills, etc.

When the child is done playing, the apparatus can then be disassembled, laid flat or folded as desired, and stored in such manner as to require a minimum amount of storage space. In the alternative, the apparatus could also remain assembled and be used as a collection point for other toys or laundry, etc.

DETAILED DESCRIPTION OF THE DRAWINGS

Figure 1:
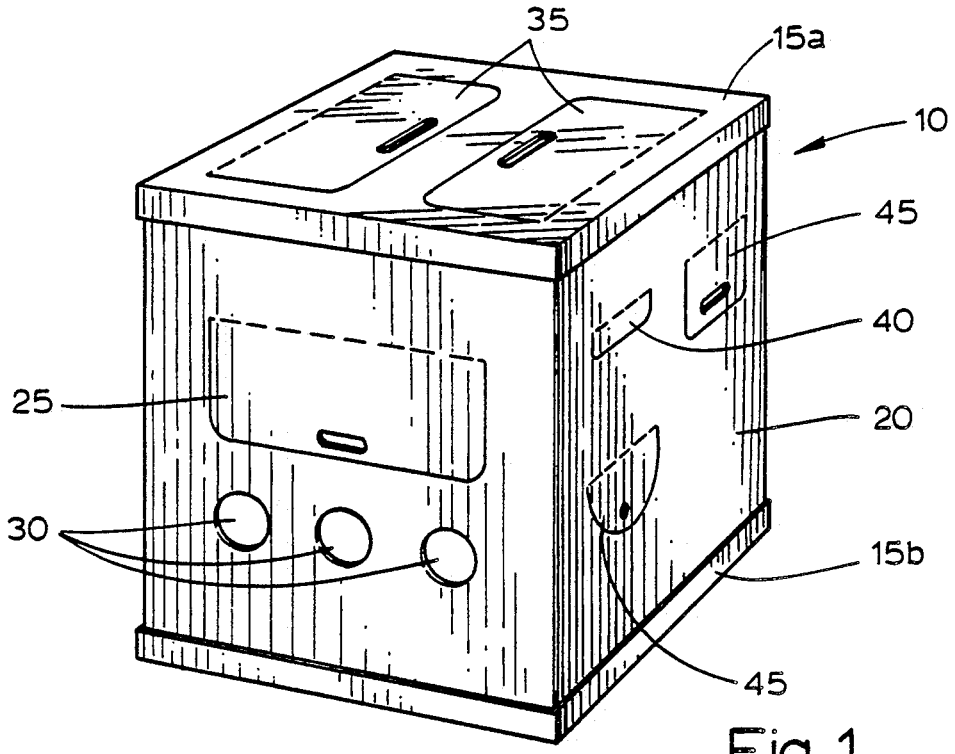
FIG. 1 is a perspective view of the play house of the present invention showing the top and bottom slid over the side wall.

Referring now to the drawings wherein like reference characters represent like elements, FIG. 1 shows a play house 10 which is comprised of top and bottom pieces 15*a* and 15*b*, respectively, and side wall 20. Play house 10, when in its assembled state as shown, is cubically shaped. Top piece 15*a* is provided with two hatchways 35, which are identically sized. Hatchways 35 are cut from top piece 15*a* on three sides; the fourth side is scored to allow hatchways 35 to open and close. Hatchways 35 are further provided with cutouts (not numbered) which allow a child's hand to be inserted so that hatchways 35 can be easily opened and closed.

Side wall 20 is scored at three places in spaced relationship so that when wall 20 is folded, a cubical structure is formed. Side wall 20 is further provided with a variety of different sized openings which permit the child to play in a number of ways. In one of various possible embodiments of the device, a first section of side wall 20 is provided with a stage door 25. Stage door 25 is cut from side wall 20 on three sides; the fourth side is scored to allow stage door 25 to be opened for performances. In a preferred embodiment, stage door 25 will be provided on its interior side with means which will allow the door to remain open during performances. Stage door 25 is also provided with a cutout (not numbered) which will allow a child's hand to be inserted so that the stage door can be opened or closed, or in the alternative, to see if the audience is in place for the performance. The first section of side wall 20 also includes a plurality of circular apertures 30 through which puppets may be passed during or after the performance.

A second section of side wall 20, in one of various possible embodiments of the device, is provided with a slot 40. Slot 40 is cutout on three sides and scored on the fourth side to permit the slot to be opened or closed. Slot 40 is sized to operate as a mail slot or as a position for discrete viewing depending on the play engaged in by the child. The second section of side wall 20 is further provided with a plurality of passageways 45, which may be of any of a number of configurations (a semi-circular door and a trap door are shown) through which hands or feet may be extended or, in the alternative, toys, food or other articles may be received or dispensed depending on the play engaged in by the child.

As was earlier stated, bottom piece 15*b* and top piece 15*a* may be identically constructed. By providing hatchways on bottom piece 15*b*, a child may enter and exit the apparatus from either end and may use the device as a maze, if desired.

Figure 2:
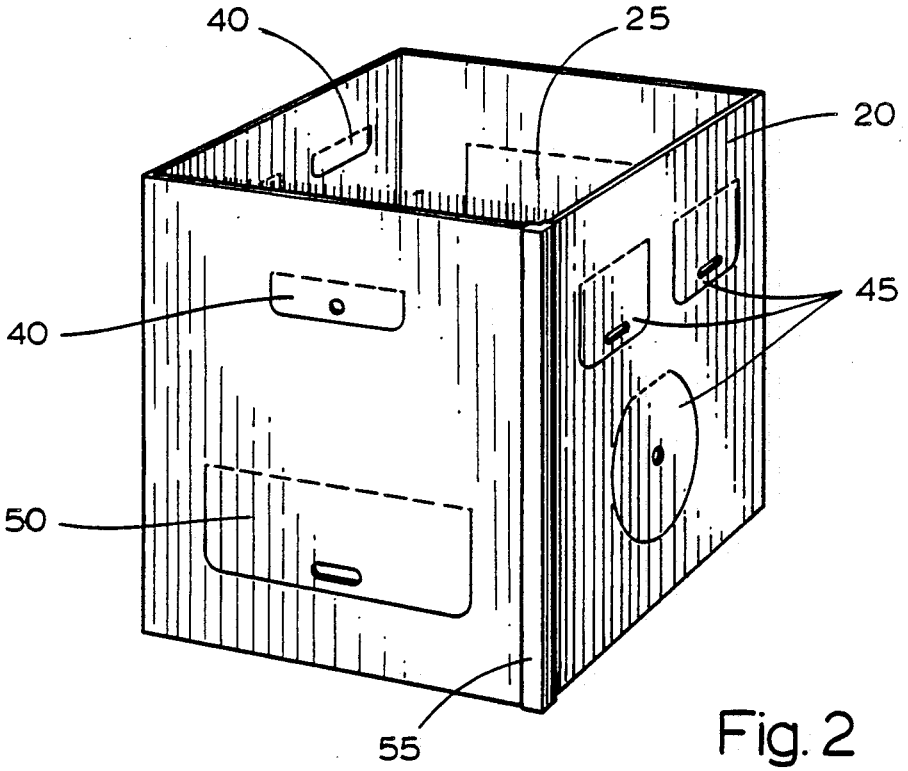
FIG. 2 is a perspective view of the side wall of the play house of FIG. 1 without the top and bottom and showing the lateral edges of the side wall being joined by a corner piece.

FIG. 2 shows the device of FIG. 1 with the top and bottom pieces removed and from an opposite vantage point. As will be seen, the lateral edges of side wall 20 are mated with a corner piece 55. Corner piece 55 may be constructed of any of various known materials. In a preferred embodiment, however, it will be rigid so as to maintain the device in an upright position. Additionally a third section of side wall 20 is provided with a slot 40 and with an aperture 50. In this configuration, slot 40 is cutout on three sides, scored on the fourth side to allow opening and closing, and incorporates a circular opening (not numbered) through which a child's finger can be inserted to open or close the slot or from which discrete viewing can take place depending on the play engaged in by the child. Aperture 50, like stage door 25, is cutout on three sides, scored on the fourth side to permit opening and closing of the aperture, and incorporates a cutout (not numbered) through which a child's hand may be inserted to open or close the aperture.

Figure 3:
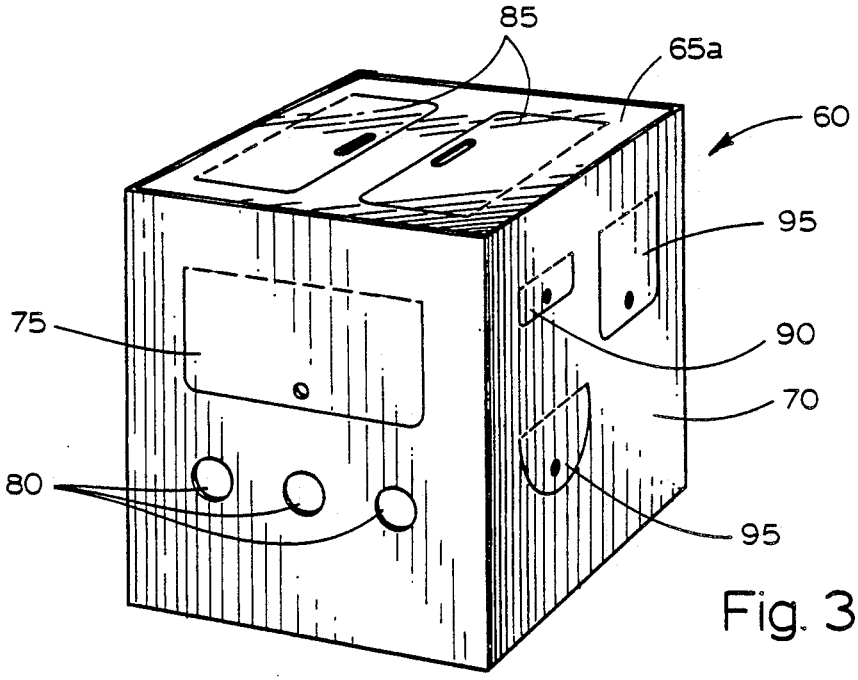
FIG. 3 is a perspective view of another embodiment of the play house of the present invention showing the top and bottom inserted within the side wall.

FIG. 3 shows an alternative embodiment of the device of the invention in which play house 60 is comprised of top piece 65*a*, bottom piece 65*b* (not shown), and side wall 70. Play house 60, when in its assembled state as shown, is cubically shaped. In this embodiment, top piece 65*a* and bottom piece 65*b* are inserted into side wall 70. Top piece 65*a* is provided with two hatchways 85, which are identically sized. Hatchways 85 are cut from top piece 65*a* on three sides; the fourth side is scored to allow hatchways 85 to open and close. Hatchways 85 are further provided with cutouts (not numbered) which allow a child's hand to be inserted so that hatchways 85 can be easily opened and closed.

Side wall 70 is scored at three places in spaced relationship so that when side wall 70 is folded, a box-like apparatus is formed. Side wall 70 is further provided with a variety of different sized openings which permit the child to play in a number of ways. In one of various possible embodiments of the device, a first section of side wall 70 is provided with a stage door 75. Stage door 75 is cut from side wall 70 on three sides; the fourth side is scored to allow stage door 75 to be opened for performances. In a preferred embodiment, stage door 75 will be provided on its interior side with means which will allow the door to remain open during performances. Stage door 75 is also provided with a cutout (not numbered) which will allow a child's finger to be inserted so that the stage door can be opened or closed, or in the alternative, to see if the audience is in place for the performance. The first section of side wall 70 also includes a plurality of circular apertures 80 through which puppets may be passed during or after the performance.

A second section of side wall 70, in one of various possible embodiments of the device, is provided with a slot 90. Slot 90 is cutout on three sides and scored on the fourth side to permit the slot to be opened or closed. It is further provided with an opening (not numbered) through which a child's finger may be inserted to open or close the slot. Slot 90 is sized to operate as a mail slot or as a position for discrete viewing depending on the play engaged in by the child. The second section of side wall 70 is further provided with a plurality of passageways 95, which may be of any of a number of configurations (a semicircular door and a trap door are shown) through which hands or feet may be extended or, in the alternative, toys, food or other articles may be received or dispensed depending on the play engaged in by the child.

Bottom piece 65*b* (not shown) and top piece 65*a* may be identically constructed. By providing hatchways on bottom piece 65*b*, a child may enter and exit the apparatus from either end and may use the device as a maze, if desired.

Figure 4:
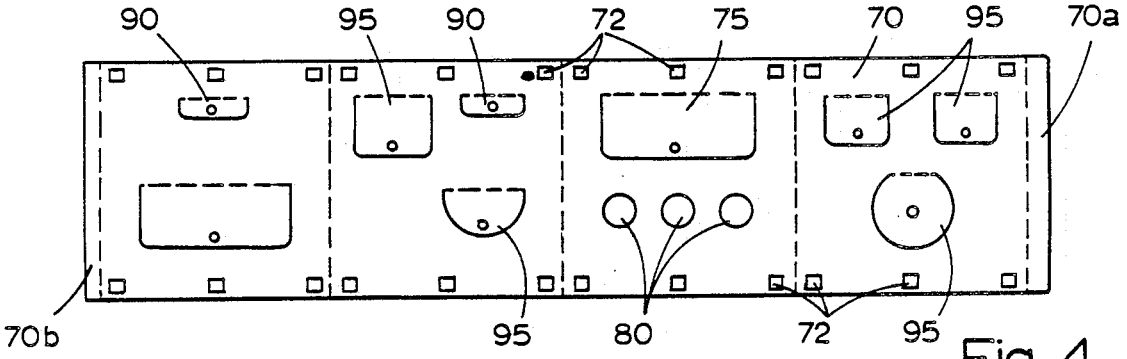
FIG. 4 is a plan view of the inside of the side wall of the play house of FIG. 3 showing means for securing the top and bottom to the side wall as well as means for joining the lateral edges of the side wall.

FIG. 4 shows the interior of side wall 70 of play house 60. As will be seen in this particular embodiment of the device of the invention, the lateral edge of side wall 70 is scored to form strip 70*a*. Strip 70*a* is provided with means which allow it to semi-permanently mate with strip 70*b* thus forming a box-like apparatus. Side wall 70 is further provided with a plurality of means 72 along its top and bottom which permit side wall 70 to semi-permanently mate with top piece 65*a* and bottom piece 65*b*. FIG. 4 also shows the variety of slots, passageways, apertures, etc. which appear in the different figures.

Figure 5:
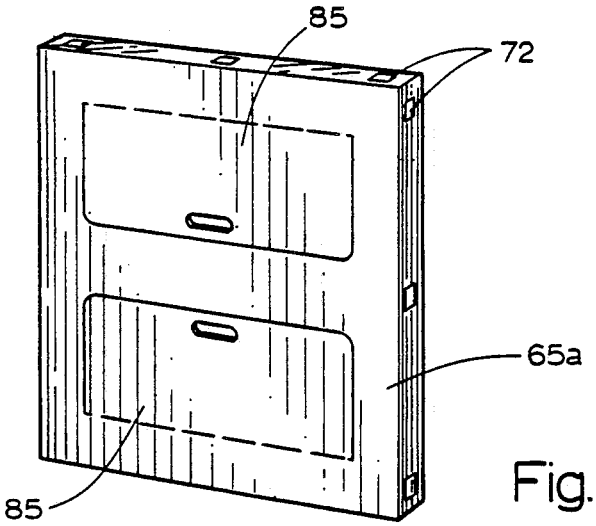
FIG. 5 is a perspective top view of the top or bottom of the play house of FIG. 3 showing means for securing the top or bottom to the side wall.

FIG. 5 further illustrates top piece 65*a*. As will be seen, means 72 are positioned along the outside of top piece 65*a* in such manner as to permit the semi-permanent mating of top piece 65*a* and side wall 70 when the top piece is inserted into the side wall. As was stated earlier, bottom piece 65*b* is provided with similar means to permit the apparatus to be assembled. It will be understood that means 72 of top piece 65*a*, bottom piece 65*b*, and side wall 70 are correlatively spaced for proper alignment and assembly.

An important feature of the invention, which has not been demonstrated, is the surface of the device. In a preferred embodiment, the surface of the educational play house, both inside and outside, is coated with a material which will not only allow a child to draw or color on it but will also permit a child to place plastic pieces on it. The coating will further allow the surface to be wiped clean of any drawing or coloring which may have been placed on it and will permit the plastic pieces to be removed. As will be understood, the surface of the device is an important feature since it permits unlimited entertainment value and provides a medium on which a child may practice certain artistic and fundamental skills. The surface coating may be of any of a number of known substances. However, in a preferred embodiment, the surface coating is composed of two layers: a first layer of semi-gloss acrylic latex paint and a second layer of high gloss polyurethane. As will be appreciated, the entire structure may be a single color or each section may be of a different color.

Earlier it was stated that the device of the invention could be transformed into a variety of playthings. The surface of the device is the means by which this transformation takes place. By using plastic pieces, such as "Colorforms", a child may decorate both the inside and outside of his creation with fictional and non-fictional characters, animals, various objects, numbers, letters, and various shapes, among other things. Further, by using markers or crayons, a child may decorate his creation in such a way as to transform it into a fire truck, race car, hospital, or theater, among other things. Additionally, he could use the device to practice his alphabet and numeric recognition, handwriting skills, learn to read, learn musical notes, and learn colors, among other things. Also, he could learn or improve his artistic skills, etc.

As will be understood, the device is easily assembled by an adult or child because it consists of a minimum number of pieces. Additionally, when the device is disassembled, it may be easily and compactly stored. In the alternative, in a preferred embodiment the device is sturdy enough to act as a collection point for other toys, clothing, etc., if the user chooses not to disassemble the device.

It should be noted that the foregoing drawings and accompanying descriptions are intended to be exemplary of two preferred embodiments of the invention and are not intended to be exhaustive of the possibilities for sizing, construction materials, the types of games which can be played, or the creations which may be "invented", which fall within the intended scope of the invention. It should also be understood that modifications will readily occur to those skilled in the art within the spirit of the invention. Such modifications could include allowing the wall portions of the apertures, passageways, and hatchways to be removed and inserted as desired.

In view of the above, it will be seen that the several objects of the invention are achieved and that other advantageous results are attained. As various changes could be made in the above product without departing from the scope of the invention, it is intended that all matter contained in the above description or shown in the accompanying drawings shall be interpreted as illustrative and not in a limiting sense.

What is claimed is:

1. A play apparatus comprising a top piece, a bottom piece, and a side wall, wherein said top piece and said bottom piece are identically sized and have a lip around each piece, and wherein said side wall has a top edge, a bottom edge and two lateral edges and is adapted at spaced intervals to permit said side wall to be folded to create an enclosure having a plurality of sides and open ends when said lateral edges of said side wall are mated, and wherein said top piece and said bottom piece are sized to mate with said open ends of said enclosure formed by said folded side wall, and wherein said top piece, said bottom piece, and said side wall may be provided with openings to allow access between the interior and exterior of said enclosure, and wherein either said top piece or said bottom piece or both said top piece and said bottom piece includes hatchways which are cut out and can be removed and inserted, as desired; and whereby during play, said side wall is folded to create said enclosure and said top piece and said bottom piece and mated with said enclosure, and whereby when play has ceased, said apparatus can be disassembled.

2. A play apparats comprising a top piece, a bottom piece, and a side wall, wherein said top piece and said bottom piece are identically sized and have a lip around each piece, and wherein said side wall has a top edge, a bottom edge and two lateral edges and is adapted at spaced intervals to permit said side wall to be folded to create an enclosure having a plurality of sides and open ends when said lateral edges of said side wall are mated, and wherein said top piece and said bottom piece are sized to mate with said open ends of said enclosure formed by said folded side wall, and wherein said top piece, said bottom piece, and said side wall may be provided with openings to allow access between the interior and exterior of said enclosure, and wherein said side wall includes passageways which are cut out and can be removed and inserted, as desired; and whereby during play, said side wall is folded to create said enclosure and said top piece and said bottom piece are mated with said enclosure, and whereby when play has ceased, said apparatus can be disassembled.

3. A play apparatus comprising a top piece, a bottom piece, and a side wall wherein aid top piece and said bottom piece are identically sized and have a lip around each piece, and wherein said side wall has a top edge, a bottom edge, and two lateral edges and is adapted at spaced intervals to permit said side wall to be folded to create an enclosure having a plurality of sides and open ends, and wherein the lateral edges of said side wall are provided with a non-permanent fastening means to permit opposite lateral edges of said side wall to be fastened in adjoining relationship, and wherein said top piece and said bottom piece are sized to mate with said open ends of said enclosure formed by said folded side wall, and wherein said top piece, said bottom piece, and said side wall are provided with non-permanent fastening means to permit said side wall and said top and bottom pieces to be fastened in fixed relationship, which means are correlatively spaced, and wherein said top piece, said bottom piece, and said side wall may be provided with openings to allow access between the interior and the exterior of said enclosure, and wherein either said top piece or said bottom piece or both said top piece and said bottom piece include(s) hatchways which are cut out and can be removed and inserted, as desired; and whereby during play, said side wall is folded to create an enclosure, opposite lateral edges of said side wall are fastened in adjoining relationship, and said top piece and said bottom piece are mated with said enclosure created by said folded side wall, and whereby when play has ceased, said apparatus can be disassembled.

4. A play apparatus comprising a top piece, a bottom piece, and a side wall wherein said top piece and said bottom piece are identically sized and have a lip around each piece, and wherein said side wall has a top edge, a bottom edge, and two lateral edges and is adapted at spaced intervals to permit said side wall to be folded to create an enclosure having a plurality of sides and open ends, and wherein the lateral edges of said side wall are provided with a non-permanent fastening means to permit opposite lateral edges of said side wall to be fastened in adjoining relationship, and wherein said top piece and said bottom piece are sized to mate with said open ends of said enclosure formed by said folded side wall, and wherein said top piece, said bottom piece, and said side wall are provided with non-permanent fastening means to permit said side wall and said top and bottom pieces to be fastened in fixed relationship, which means are correlatively spaced, and wherein said top piece, said bottom piece, and said side wall may be provided wit openings to allow access between the interior and the exterior of said enclosure, and wherein said side wall includes passageways which are cut out and can be removed and inserted, as desired, and wherein at least a portion of the interior or the exterior surface of said play apparatus has a surface to which planar forms and shapes will adhere, which surface permits said planar forms and shapes to be readily removed when no longer wanted; and whereby during play, said side wall is folded to create an enclosure, opposite lateral edges of said side wall are fastened in adjoining relationship, and said top piece and said bottom piece are mated with said enclosure created by said folded side wall, and whereby when play has ceased, said apparatus can be disassembled.

* * * * *